US006299546B1

(12) United States Patent
Wang

(10) Patent No.: US 6,299,546 B1
(45) Date of Patent: Oct. 9, 2001

(54) CLUB HEAD ASSEMBLY FOR A GOLF CLUB

(76) Inventor: Chih-Hung Wang, No. 32, Alley 9, Lane 150, Nan-Cheng 2nd Rd., Fengshan City, Kaohsiung Hsien (TW)

( * ) Notice: Subject to any disclaimer, the term of this patent is extended or adjusted under 35 U.S.C. 154(b) by 0 days.

(21) Appl. No.: 09/468,790

(22) Filed: Dec. 21, 1999

(51) Int. Cl.[7] ..... A63B 53/02
(52) U.S. Cl. ..... 473/314; 473/345
(58) Field of Search ..... 473/314, 305, 473/336, 345, 245, 247

(56) References Cited

U.S. PATENT DOCUMENTS 3,519,271 * 7/1970 Smith .
3,980,301 * 9/1976 Smith .
4,697,813 * 10/1987 Inoue .
5,197,733 * 3/1993 Schroder .
5,632,695 * 5/1997 Hlinka ..... 473/341
5,709,613 * 1/1998 Sheraw ..... 473/340
5,931,741 * 8/1999 Fenton ..... 473/305
6,048,275 * 4/2000 Gedeon ..... 473/293
6,080,068 * 6/2000 Takeda ..... 473/305

* cited by examiner

*Primary Examiner*—Jeanette Chapman
*Assistant Examiner*—Stephen L. Blau
(74) *Attorney, Agent, or Firm*—Bacon & Thomas, PLLC

(57) ABSTRACT

A club head assembly for a golf club is disclosed, which has a club head having a face defined thereon and a passage defined therein parallel to the longitudinal axis of the face, and a shaft having a distal end extending and bending therefrom with a predetermined angle, said distal end inserted into and fixedly locked in the passage.

7 Claims, 8 Drawing Sheets

CLUB HEAD ASSEMBLY FOR A GOLF CLUB

BACKGROUND OF THE INVENTION

1. Field of the Invention

The present invention relates to a club head assembly for a golf club, more particularly, to a club head assembly having excellent connectivity between the head and the shaft to avoid the distortion of the head by the torque by the ball at impact during a shot.

2. Description of Related Art

As shown in FIG. 6, the conventional putter head assembly comprises a club head (60) having a putting face (62), a crown (64) and a shank (66) integrally extending from the crown (64), and a shaft (50) having a distal end inserted into the shank (66) of the club head (60). Adhesives are used to firmly attach the distal end of the shaft (50) into the shank (66). The putting face (62) is a plain surface defined to putt a golf ball. The precise putting usually depends on the skill of a player. However, when putting a golf ball, a counter-action force is exerted from the ball to the putting face (62) resulting in a torque between the putting point and the shank (66) that destroys the adhesive layer in the shank (62) and causes the putting face (62) to rotate relative to the distal end of the shaft (50). A problem of misalignment of the club head (40) relative to the shaft (50) likely occurs without being perceived by the player so that an error in putting occurs.

Similarly, misalignment of the club head (70) of a wood or of the head body (80) of an iron (see FIG. 7 and FIG. 8) relative to the shaft also occurs. In the case where the oblique of the head is found in a wood, the trajectory of the golf ball hit by such an oblique head will be off-line away from the player instead of being straight.

SUMMARY OF THE INVENTION

The objective of the present invention is to provide a club head assembly for a golf club capable of retaining precise alignment when hitting or putting a golf ball.

To achieve the objective, the club head assembly for a golf club in accordance with the present invention comprises a club head having a face and a longitudinal passage defined therein parallel to the longitudinal axis of the face, and a shaft having a distal end inserted into and fixedly locked in the longitudinal passage.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
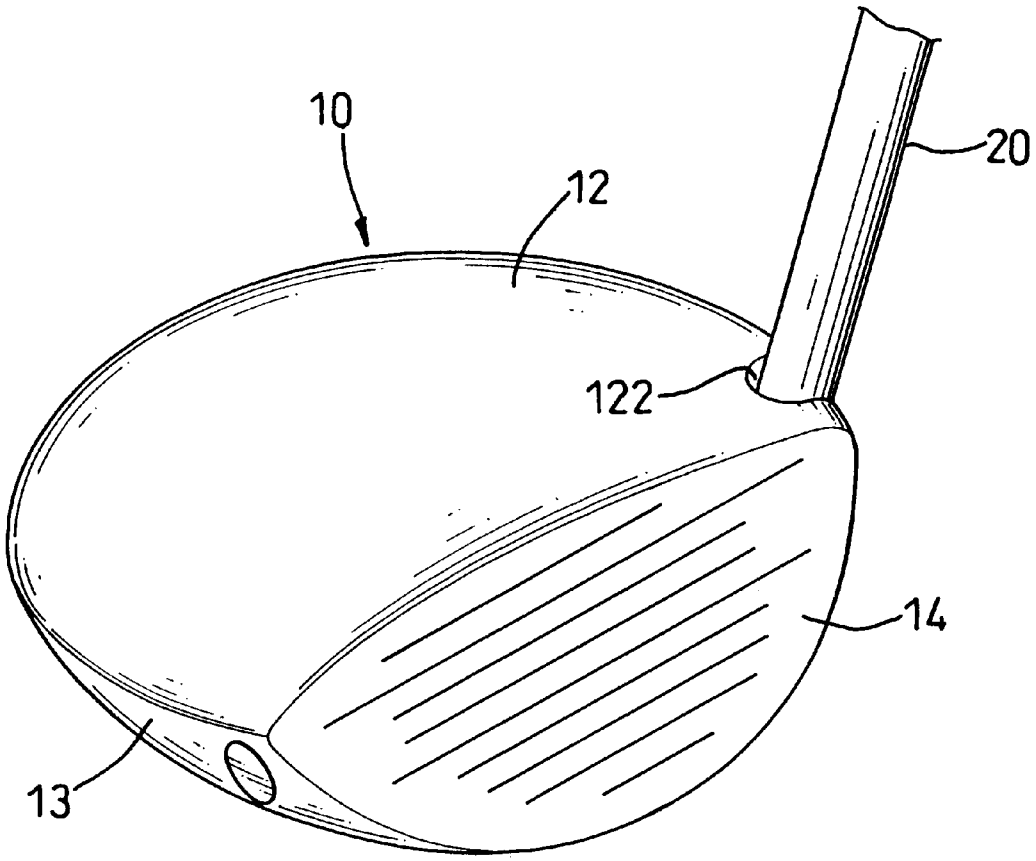
FIG. 1 is a perspective view of a "wood" club head assembly for a golf club in accordance with the present invention.
Figure 2:
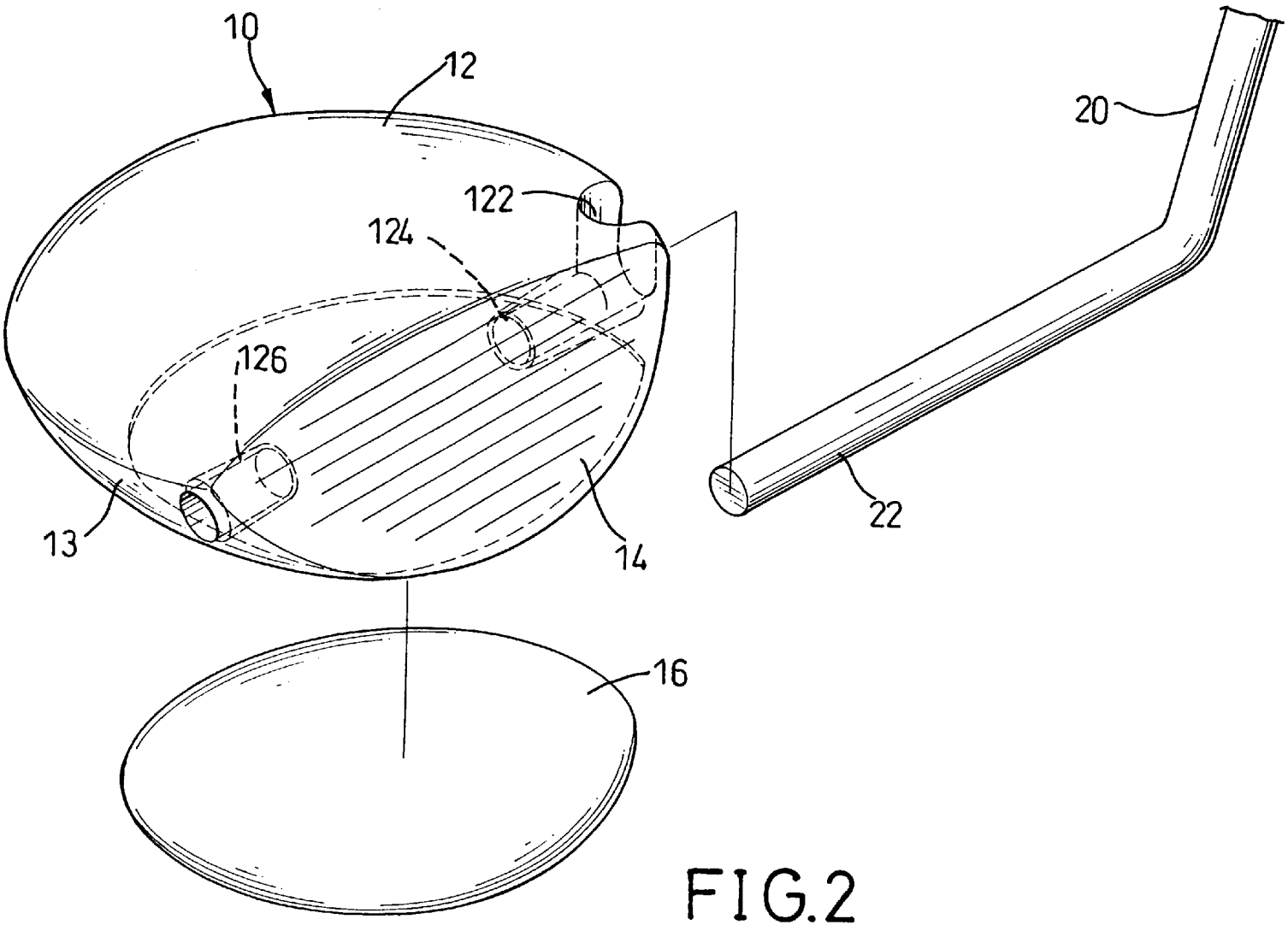
FIG. 2 is an exploded perspective view of the club head assembly in FIG. 1.
Figure 3:
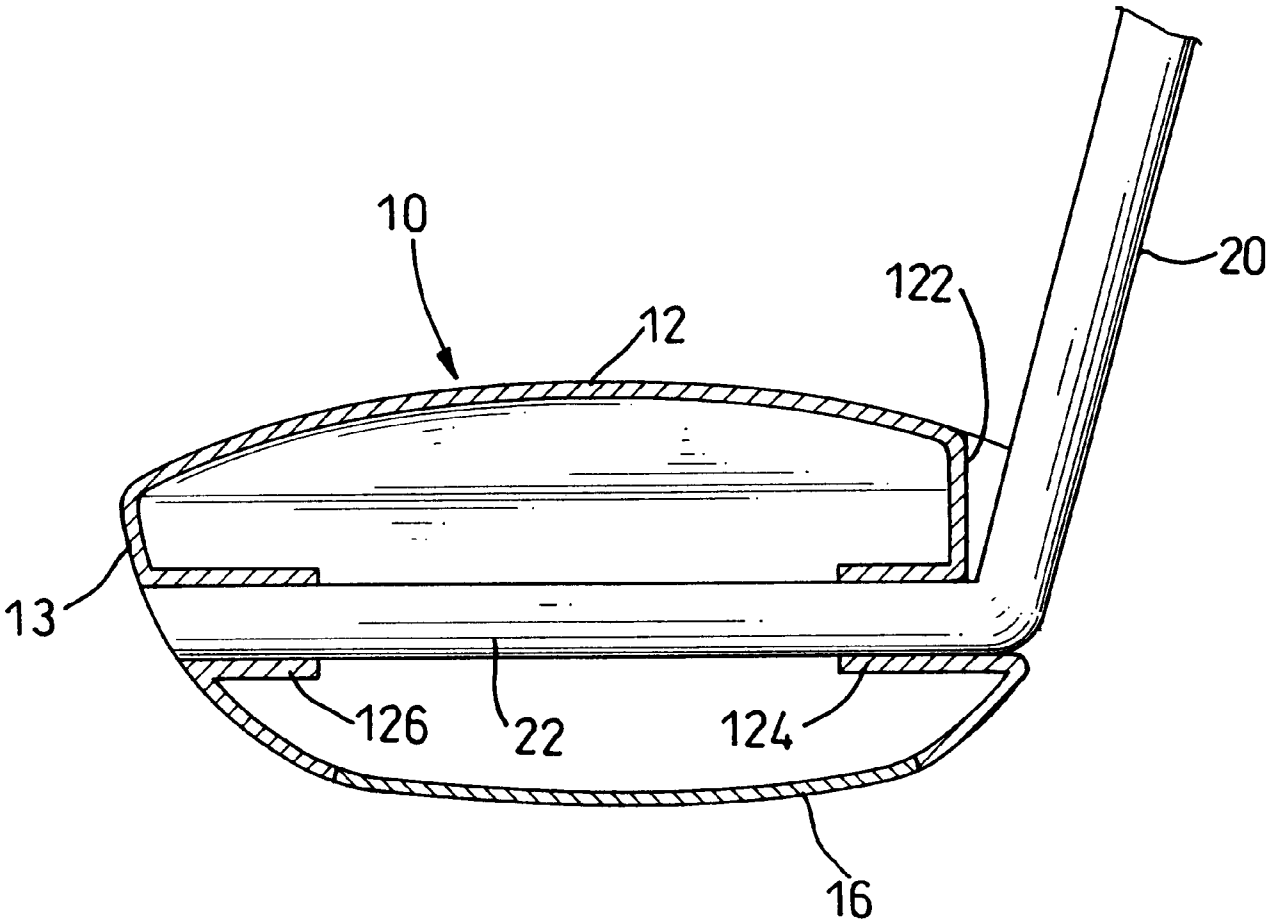
FIG. 3 is a cross-sectional front plain view of the club head assembly in FIG. 1.

With reference to FIG. 1 to 3, the embodiment of the "wood" club head assembly for a golf club in accordance with the present invention comprises a club head (10) and a shaft (20). The hollow club head (10) has a hitting face (14), a surrounding wall (13) connecting to the sides and bottom of the hitting face (14), a passage extending inside the head body (10), a crown (12) and a foot (16) connected by the surrounding wall (13).

The hitting face (14) is a plane face used to contact and hit a golf ball and has a longitudinal axis.

The passage is formed by two tubes (124, 126) that are integrally formed on the surrounding wall (13) near the joint of the face (14) and the surrounding wall (13), and respectively extends inside the head body (10). The two tubes (124, 126) are aligned with each other and have a longitudinal axis parallel to the longitudinal axis of the hitting face (14). The tube (124) also has an inlet on the surface of the head body (10).

A recess (122) is defined on one side of the crown (12) to receive one part of the shaft (20).

The foot (16) may be integrally formed with the surrounding wall (13) or be a separate piece connected to the surrounding wall (13).

The shaft (20) has a distal end (22) extending and bending therefrom at a predetermined angle. The distal end (22) can be inserted, from the inlet of the tube (124), into the passage of the head body (10) formed by the two tubes (124, 126) with the vertical part of the shaft (20) received in the recess (122). Then, locking means such as adhesives or screws can further be used to fix the distal end (22) in the tubes (124, 126).

In a variation of the embodiment in FIGS. 1 to 3, the corresponding ends of the two tubes (124, 126) can be extended toward each other to form a single tube (not shown).

In another variation of the embodiment in FIGS. 1 to 3, the club head (10) can be solid with a passage extending along its longitudinal axis and having an inlet on a surface of the head body (10).

Figure 4:
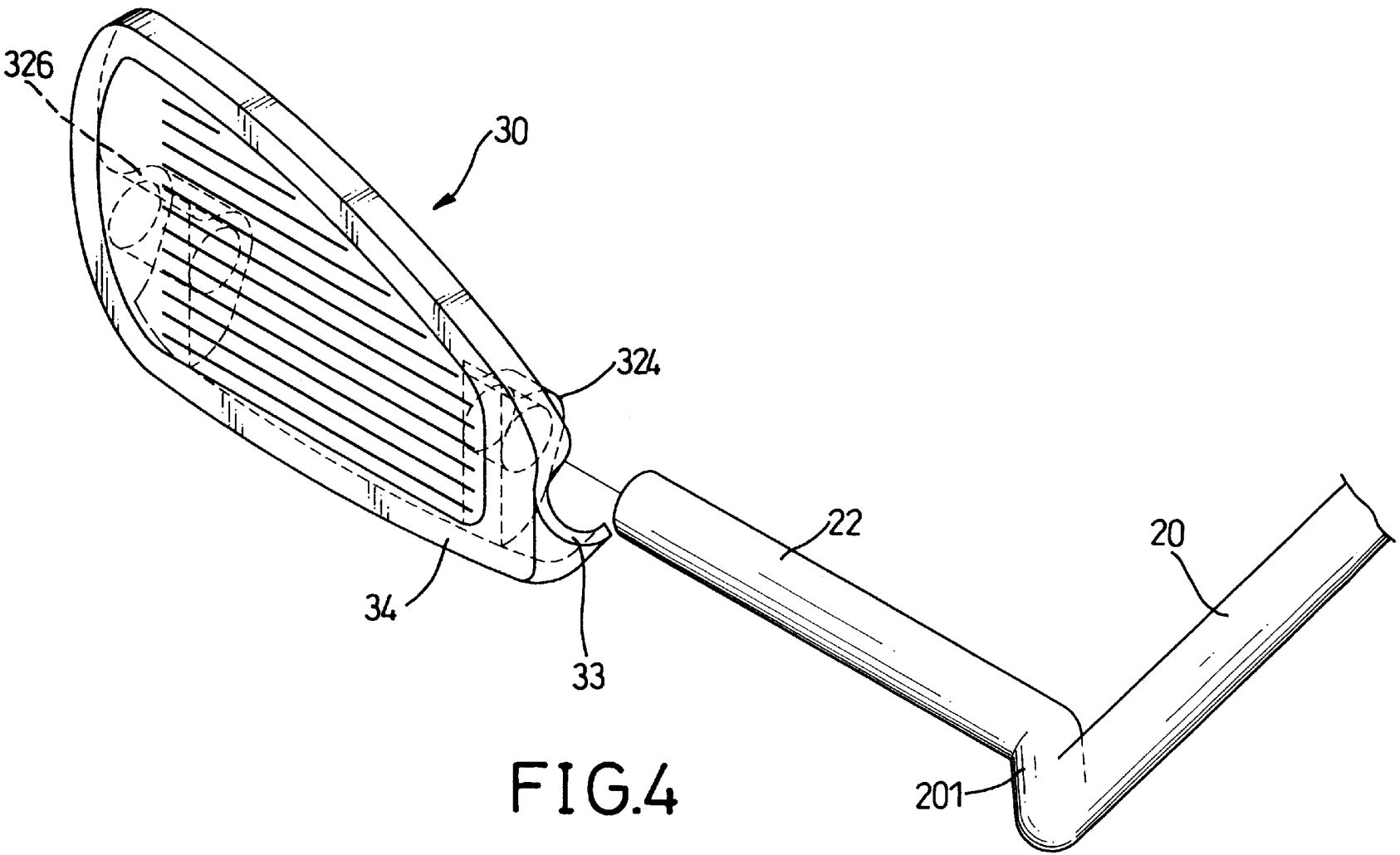
FIG. 4 is an exploded perspective view of an "iron" club head assembly in accordance with the present invention.

With reference to FIG. 4, another embodiment of the club head assembly for a golf club comprises an "iron" club head (30) and a shaft (20). The club head (30) is a plate having a face (34), two tubes (324, 326) integrally formed on the rear face of the plate and a semi-collar (33) extending from an edge of the face (10) near the tube (324).

The semi-collar (33) is curved to receive one part of the shaft (20). The longitudinal axis of the semi-collar (33) is oblique to that of the hitting face (34) with a predetermined angle.

The longitudinal axes of the two tubes (324, 326) are aligned with each other and are parallel to the hitting face (34). A passage is formed between the two tubes (324, 326) with an inlet formed on the tube (324).

The shaft (20) has a neck (201) integrally extending and bending therefrom with a predetermined angle, and a distal end (22) extending and bending from the neck (201) with a predetermined angle. The distal end (22) can be inserted, from the inlet of the tube (324), into the passage formed by the two tubes (324, 326) with a part of the shaft (20) being received in the semi-collar (33).

Similarly, adhesives or screws can be used to fix the distal end (22) in the two tubes (324, 326) or the part of the shaft (20) in the semi-collar (33).

Similarly, the two tubes (324, 326) can be integral to form a single tube.

Figure 5:
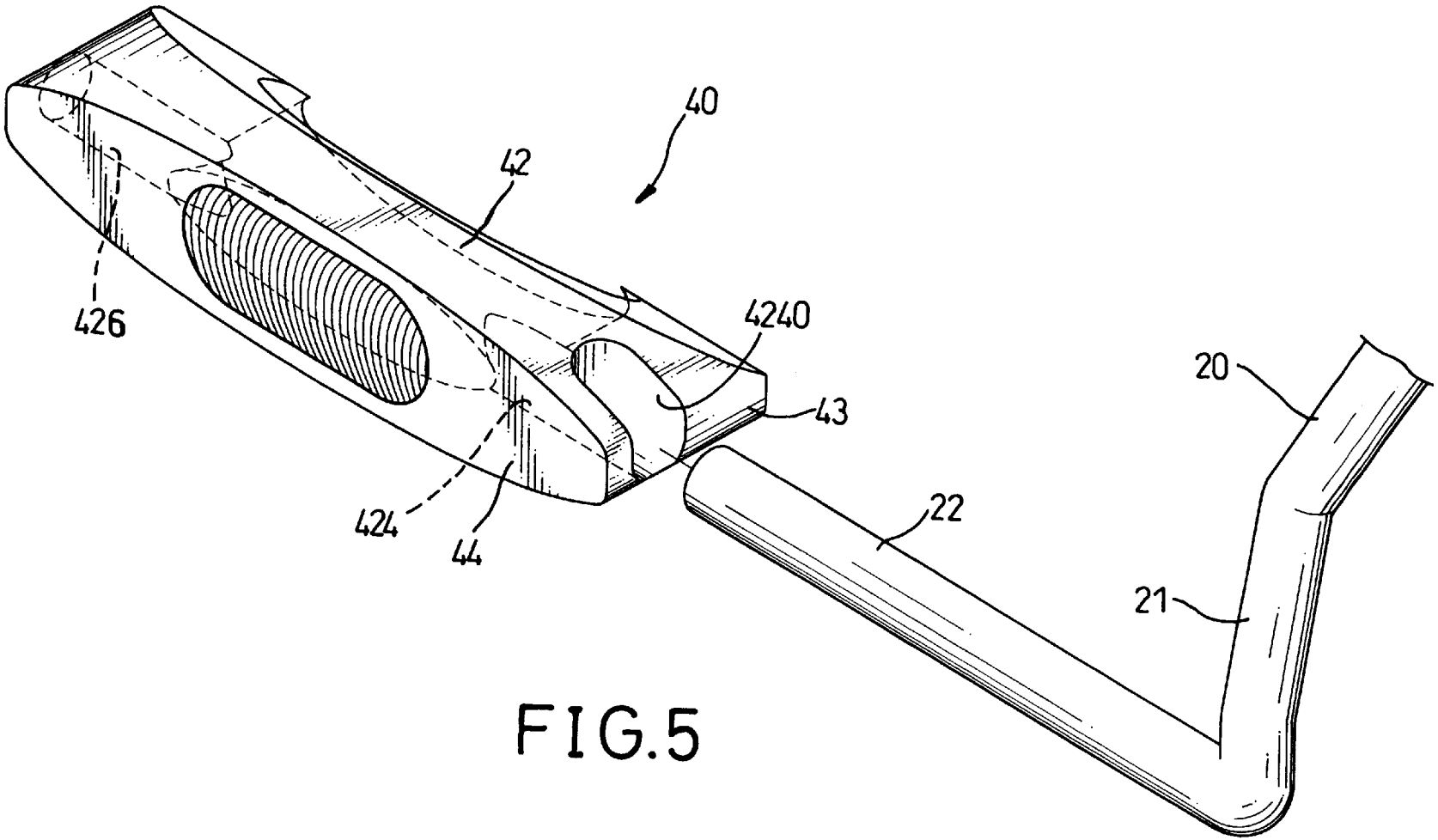
FIG. 5 is an exploded perspective view of a putter club head assembly in accordance with the present invention.
Figure 6:
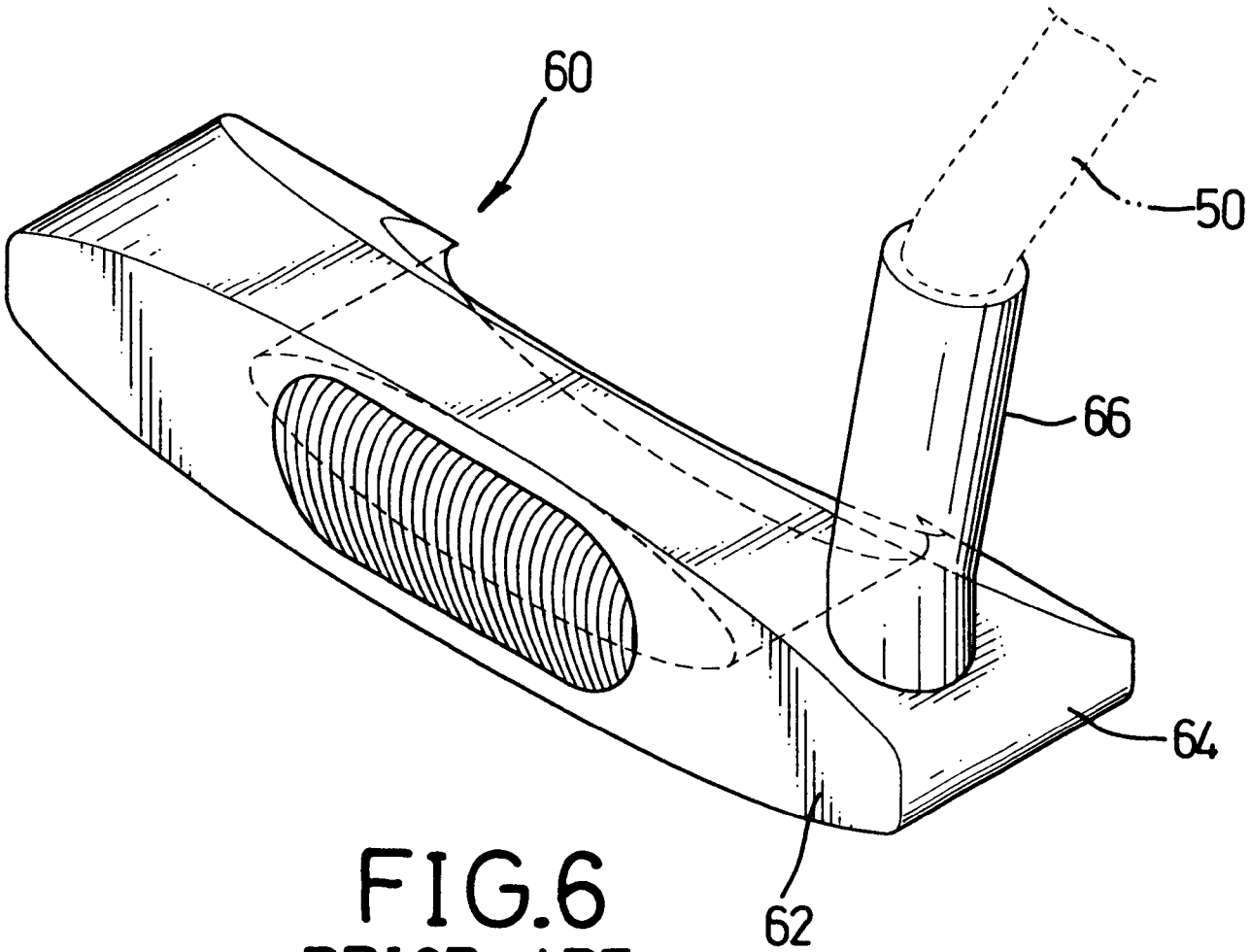
FIG.6 PRIOR ART
FIG. 6 is an exploded perspective view of a putter head assembly in accordance with the prior art.
Figure 7:
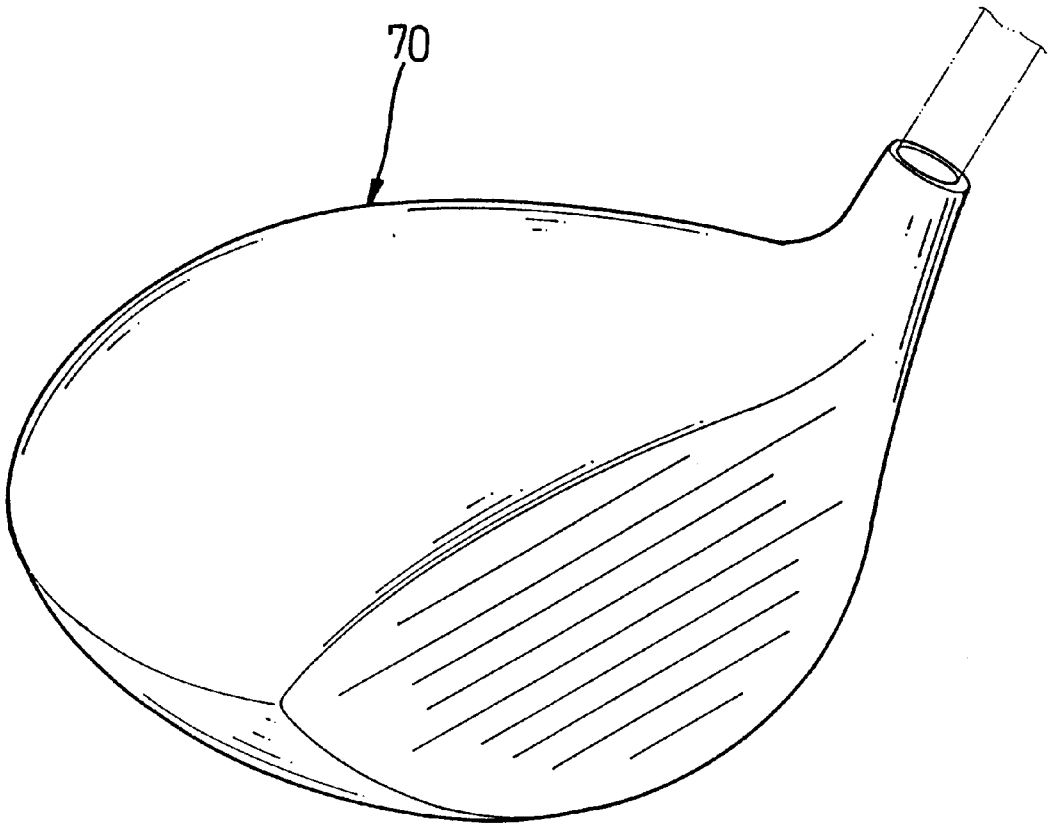
FIG.7 PRIOR ART
FIG. 7 is a perspective view of a "wood" club head assembly in accordance with the prior art.
Figure 8:
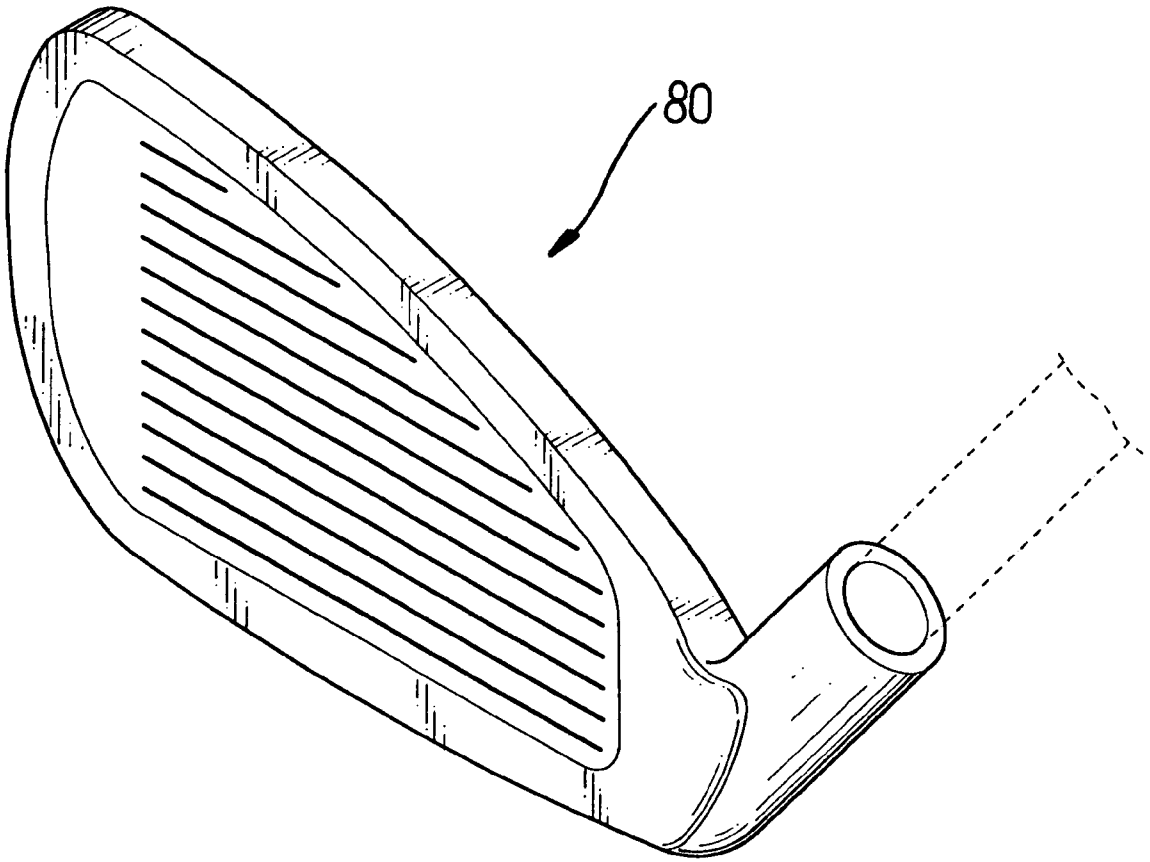
FIG.8 PRIOR ART
FIG. 8 is a perspective view of an "iron" club head assembly in accordance with the prior art.

With reference to FIG. 5, a variation of the club head assembly comprises a club head (40) and a shaft (20). The club head (40) is hollow and has a putting face (44), two horizontal faces (42) each connecting to one side of the putting face (44) and two vertical walls (43) each connecting another side of the putting face (44).

Each of the two vertical walls (43) has a tube (424, 426) extending into the head body (40). The longitudinal axes of the two tubes (424, 426) are aligned with each other and parallel to the putting face (44). The tube (424) further has a recess (4240) in one of the horizontal faces (42) and an inlet formed on one end thereof.

The shaft (20) has a neck (21) extending and bending therefrom with a predetermined angle and a distal end (22) extending and bending from the neck (21). The distal end (22) can be inserted into the two tubes (424, 426) with a part of the neck (21) being received in the recess (4240). Then, adhesives or screws can be used to fix the distal end (22) in the two tubes (424, 426). With the club head assembly for golf club, the problems of head oblique found in prior art will be obviated because the face is supported by the parallel distal end. Therefore, when hitting a golf ball the face will not be oblique when it comes in contact with the ball, such that the precision in striking the ball will be excellent. Additionally, the distal end can reinforce the face to amplify the force exerted by the face when hitting.

Although the present invention has been explained in relation to its preferred embodiment, it is to be understood that many other possible modifications and variations can be made without departing from the spirit and scope of the invention as hereinafter claimed.

What is claimed is:

1. A club head assembly for a golf club, comprising:

a club head forming a hollow body, said club head including a face with a longitudinal axis defined thereon, a wall surrounding said face, and a passage defined to have a longitudinal axis parallel to the longitudinal axis of the face and an inlet defined thereon; and a shaft with a distal end extending and bending therefrom with a predetermined angle and being fixedly inserted through the inlet into the passage of the club head, wherein the passage is formed by a tube integrally extending from the surrounding wall into the club head.

2. The club head assembly for a golf club as claimed in claim 1, wherein a recess is further formed on the surrounding wall of the club head near the inlet of the tube to receive a part of the shaft.

3. The club head assembly for a golf club as claimed in claim 1, wherein a recess is further formed on the club head near the inlet of the passage to receive a part of the shaft.

4. The club head assembly for a golf club as claimed in claim 1, wherein adhesives are used to fix the distal end in the passage.

5. The club head assembly for a golf club as claimed in claim 1, wherein screws are used to fix the distal end in the passage.

6. A club head assembly for a golf club comprising:

a club head forming a hollow body, said club head including a face with a longitudinal axis defined thereon, a wall surrounding the face, and a passage defined to have a longitudinal axis parallel to the longitudinal axis of the face and an inlet defined thereon; and a shaft with a distal end extending and bending therefrom at a predetermined angle and being adapted to be inserted through the inlet into a passage of the club head, wherein the passage is formed by two tubes each integrally extending from the wall into the head body and being aligned with each other, one of said two tubes having an inlet to allow the distal end of the shaft to pass therethrough.

7. The club head assembly for a golf club as claimed in claim 6, wherein a recess further extends from the inlet of the tube to receive a part of the shaft.

* * * * *